US011338256B2

(12) United States Patent
Shi et al.

(10) Patent No.: US 11,338,256 B2
(45) Date of Patent: May 24, 2022

(54) AUTOMATIC SEALANT PRODUCTION LINE

(71) Applicant: Guangzhou Baiyun Chemical Industry Co., Ltd., Guangdong (CN)

(72) Inventors: Xiaohua Shi, Guangdong (CN); Xueqing Hu, Guangdong (CN); Xuexin Pang, Guangdong (CN); Mingsong Miao, Guangdong (CN); Zhenhai Liu, Guangzhou (CN); Jianjin Lin, Guangdong (CN); Haolin Hu, Guangdong (CN)

(73) Assignee: Guangzhou Baiyun Chemical Industry Co., Ltd., Guangdong (CN)

( * ) Notice: Subject to any disclaimer, the term of this patent is extended or adjusted under 35 U.S.C. 154(b) by 0 days.

(21) Appl. No.: 17/262,463

(22) PCT Filed: Dec. 7, 2018

(86) PCT No.: PCT/CN2018/119687
§ 371 (c)(1),
(2) Date: Jan. 22, 2021

(87) PCT Pub. No.: WO2020/113540
PCT Pub. Date: Jun. 11, 2020

(65) Prior Publication Data

US 2021/0322935 A1 Oct. 21, 2021

(51) Int. Cl.
*B65B 3/04* (2006.01)
*B01F 23/47* (2022.01)
(Continued)

(52) U.S. Cl.
CPC ..... *B01F 23/47* (2022.01); *B01F 33/82* (2022.01); *B01F 35/90* (2022.01); *B65B 1/30* (2013.01);
(Continued)

(58) Field of Classification Search
CPC ..... B01F 23/47; B01F 33/80; B01F 33/82; B01F 35/90; B01F 2035/3512;
(Continued)

(56) References Cited

U.S. PATENT DOCUMENTS 4,279,360 A * 7/1981 Hauser ..... B29C 31/06 222/1
5,547,000 A 8/1996 Kemp et al.
(Continued)

FOREIGN PATENT DOCUMENTS

CN 1749346 3/2006
CN 202898318 4/2013
(Continued)

OTHER PUBLICATIONS

Chinese First Office Action dated Sep. 3, 2020 with English Translation for Chinese Patent Application No. 201880002378.1.
(Continued)

*Primary Examiner* — Nicolas A Arnett
(74) *Attorney, Agent, or Firm* — McCarter & English, LLP

(57) ABSTRACT

Disclosed is an automatic sealant production line, including a sealant preparation apparatus and a packaging apparatus. The sealant preparation apparatus includes a material storage device, a liquid storage device, a material sending device, a lateral material feeding device, a first-order screw unit, a first liquid feeding device, a heat exchanger, a second-order screw unit, a pigment feeding device, a cooler and a buffer tank device. The packaging apparatus includes a filling device and a packaging device.

17 Claims, 4 Drawing Sheets

(51) Int. Cl.

| | |
|---|---|
| ***B65B 3/08*** | (2006.01) |
| ***B01F 33/82*** | (2022.01) |
| ***B01F 35/90*** | (2022.01) |
| ***B65B 61/28*** | (2006.01) |
| ***B65B 1/30*** | (2006.01) |
| *B01F 35/30* | (2022.01) |
| *B01F 101/36* | (2022.01) |
| *B65B 21/02* | (2006.01) |

(52) U.S. Cl.
CPC ..... *B65B 3/08* (2013.01); *B65B 61/28* (2013.01); *B01F 2035/3512* (2022.01); *B01F 2101/36* (2022.01); *B65B 21/02* (2013.01)

(58) Field of Classification Search
CPC ..... B01F 2101/36; B01F 35/00; B65B 1/30; B65B 3/08; B65B 61/28; B65B 21/02
See application file for complete search history.

(56) References Cited

U.S. PATENT DOCUMENTS

| | | | | |
|---|---|---|---|---|
| 8,768,504 | B2 * | 7/2014 | Weber | B29C 45/4005 700/203 |
| 10,513,052 | B2 * | 12/2019 | Suzuki | B29C 39/24 |
| 2021/0032470 | A1 * | 2/2021 | Johnson | B29C 67/246 |

FOREIGN PATENT DOCUMENTS

| | | |
|---|---|---|
| CN | 103230756 | 8/2013 |
| CN | 103624955 | 3/2014 |
| CN | 103862649 | 6/2014 |
| CN | 205886789 | 1/2017 |
| CN | 206266478 | 6/2017 |
| CN | 207327354 | 5/2018 |
| GB | 1358246 A | 7/1974 |

OTHER PUBLICATIONS

PCT International Search Report dated Aug. 27, 2019, for International Patent Application No. PCT/CN2018/119687.

* cited by examiner

AUTOMATIC SEALANT PRODUCTION LINE

CROSS-REFERENCE TO RELATED APPLICATION

This patent application is a 35 U.S.C. § 371 National Stage filing of International Application No. PCT/CN2018/119687, filed on Dec. 7, 2018, the disclosure of which is incorporated herein by reference in its entirety.

TECHNICAL FIELD

The present disclosure relates to an intelligent automatic continuous production equipment and, in particular, to an automatic sealant production line.

BACKGROUND

In the existing art, the production of sealant is divided into batch production and continuous production. The batch production is convenient to operate, and the production control is relatively simple, but the processes are discontinuous. The intermediate product obtained in each process needs to be manually transported to the next process, resulting in a large material transfer loss between a previous process and a subsequent process. In addition, due to the docking between the previous process and the subsequent process, the material transfer time is relatively long, so that the material is prone to crust when being exposed to the air, which is susceptible to seasonal changes. Therefore, the production reliability is poor and the quality of each batch is uneven, which is not conducive to the quality control of products.

At present, a continuous production line is gradually popularized. The automatic sealant production line is mainly composed of a sealant manufacturing process and a subpackaging and boxing process, and includes a metering system, a mixing system, a cooler, a filter, a buffer tank and a subpackaging and palletizing device. Although the problem of the batch production line can be solved to some extent, some problems to be solved urgently still exist among the systems and devices of the automatic production line. For example, an excessively high pressure of a screw machine system, a poor liquid feeding condition and a poor liquid storage condition lead to a production interruption or an increase of rejection rate of the continuous production line, and an excessively high pressure of a pigment static mixer leads to overheating and a subsequent production interruption of a quantitative cylinder hydraulic system.

SUMMARY

Provided is an automatic sealant production line against the deficiencies in the existing art.

The present disclosure adopts the following solutions.

An automatic sealant production line is provided and includes a sealant preparation apparatus and a packaging apparatus. The sealant preparation apparatus includes a material storage device, a liquid storage device, a material sending device, a lateral material feeding device, a first-order screw unit, a first liquid feeding device, a heat exchanger, a second-order screw unit, a pigment feeding device, a cooler and a buffer tank device. The packaging apparatus includes a filling device and a packaging device.

The material storage device, the material sending device, the lateral material feeding device, the first-order screw unit, the heat exchanger, the second-order screw unit, the cooler and the buffer tank device are sequentially connected, the liquid storage device is connected, through the first liquid feeding device, to the lateral material feeding device and the first-order screw unit separately. The pigment feeding device is connected to the second-order screw unit.

A downstream portion of the buffer tank device is connected to the filling device, and sealant is boxed and palletized by the packaging device after being bottled by the filling device.

As an alternative solution of the automatic sealant production line, the automatic sealant production line further includes a second liquid feeding device. The liquid storage device is connected, through the second liquid feeding device, to the first-order screw unit.

As an alternative solution of the automatic sealant production line, the automatic sealant production line further includes a third liquid feeding device. The third liquid feeding device includes a pneumatic stirring liquid storage tank, a metering hopper, a pneumatic valve and a pneumatic diaphragm pump. The pneumatic diaphragm pump is configured to convey adjuvant to the second-order screw unit.

As an alternative solution of the automatic sealant production line, the liquid storage device includes a liquid storage tank, a pressure-type liquidometer, an outfeed high-viscosity pump and an online raw material liquid pre-preparation system. The outfeed high-viscosity pump is configured to pump liquid materials. The online raw material liquid pre-preparation system includes a reaction kettle, a high-viscosity pump, a thermal-oil heating device, a cooler and an electrical control system. A weighing module for measuring the weight of various mixed liquid material is mounted to the reaction kettle. The cooler is configured to allow cooling water to pass through such that outlet material can be cooled and the requirement that material on the normal temperature is supplied online can be met.

As an alternative solution of the automatic sealant production line, the pigment feeding device includes a pigment storage device and a metering pump. The pigment storage device includes a material pressing machine, a pigment storage tank and a valve. The pigment pressing machine is provided with an ultrasonic probe. The pigment in the pigment storage tank is configured to convey, through the metering pump, to the second-order screw unit.

As an alternative solution of the automatic sealant production line, the heat exchanger includes a storage tank and a plurality of copper pipes disposed within the storage tank. The plurality of the copper pipes are configured to receive external hot water and chilled water. An inlet end of the storage tank is connected to a material outlet of the first-order screw unit, and an outlet end of the storage tank is connected to a material inlet of the second-order screw unit.

As an alternative solution of the automatic sealant production line, the storage tank is provided with a chilled water inlet valve, a hot water inlet valve, a chilled water outlet valve, a hot water outlet valve and a material temperature probe.

As an alternative solution of the automatic sealant production line, the chilled water inlet valve and the hot water inlet valve are configured to be controlled in an interlocking mode, the chilled water inlet valve and the chilled water outlet valve are configured to be controlled in a cascade mode, and the hot water inlet valve and the hot water outlet valve are controlled in the cascade mode.

As an alternative solution of the automatic sealant production line, an inlet end of the heat exchanger is provided with a melt pressure probe.

As an alternative solution of the automatic sealant production line, a liquid material storage metering unit is configured to be sealed by nitrogen supplied by a nitrogen sealing system. The nitrogen sealing system includes a nitrogen generator, a gas storage tank, a self-operated pressure reducing valve, a nitrogen discharging valve and a safety valve. The self-operated pressure reducing valve is configured to adjust pressure by taking the pressure of pressure measuring points of each working tank or metering hopper. The pressure measured is controlled in a range of kilopascals so that online metering of production is not influenced.

As an alternative solution of the automatic sealant production line, the packaging device includes an automatic boxing device and an automatic palletizing device.

The present disclosure has beneficial effects described below.

(1) By a self-contained hot water heating function of the heat exchanger, residual material can be melted and completely emptied so that the excellent cooling effect is implemented when chilled water is input; meanwhile, the outputting pressure of the screw machine can be reduced so that the condition of overflowing is reduced.

(2) The pneumatic stirring liquid storage tank of the third liquid feeding device can stir adjuvant evenly so that products are not influenced by non-uniform ingredients of the adjuvant caused by precipitation of a part of substances, and the rejection rate can be reduced; a metering hopper prestoring a certain amount of adjuvant is further provided so that continuous production can be maintained when the pneumatic stirring liquid storage tank is replaced.

(3) The pigment of the pigment feeding device is conveyed by the second-order screw unit to be evenly mixed so that high pressure provided for static mixing when adding pigment is avoided; meanwhile, an ultrasonic probe is disposed on the material pressing machine for measuring the storage state of the pigment in time so that the quick replacement of the pigment is implemented, and continuous production is ensured.

(4) The nitrogen sealing system is adopted for all liquid storage units and liquid feeding units in the whole line so that the liquid material is ensured not to be influenced by external gas, and the quality of continuously produced products is ensured in all aspects.

(5) The liquid material required by the main line is prepared online with raw materials so that the performances, especially the stability and the homogeneity of the liquid material are ensured. A stable production mode to process from raw material to intermediate and then to finished products is easier to implement, the quality of the finished products is more effectively ensured, and the automation degree of the whole line is also improved.

(6) The filling device and the automatic palletizing device are provided so that systematic production from raw material to products is achieved.

BRIEF DESCRIPTION OF DRAWINGS

The following is a further detailed description of the present disclosure according to the drawings and the embodiments.

DETAILED DESCRIPTION

The following is a further description of the solution of the present disclosure in conjunction with the drawings and the embodiments.

Embodiment One

Figure 1:
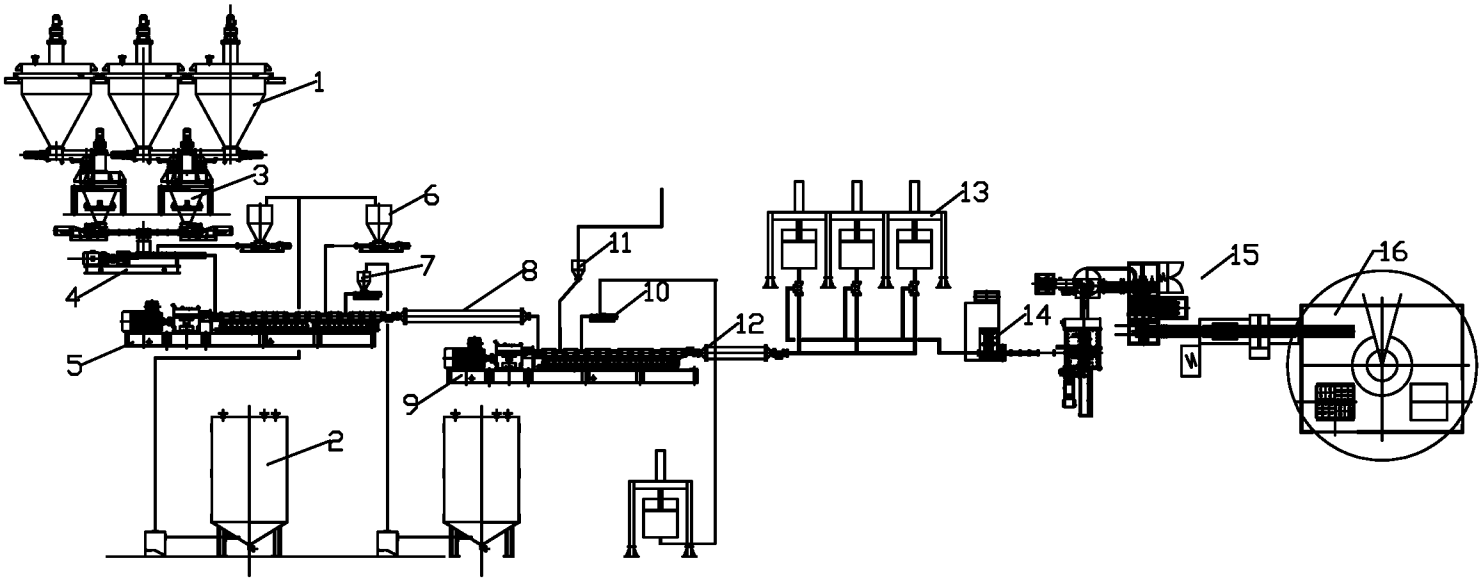
FIG. 1 illustrates an automatic sealant production line according to the present disclosure.

As shown in FIG. 1, in the embodiment, the automatic sealant production line according to the present disclosure includes a sealant preparation apparatus and a packaging apparatus. The sealant preparation apparatus includes a material storage device 1, a liquid storage device 2, a material sending device 3, a lateral material feeding device 4, a first-order screw unit 5, a first liquid feeding device 6, a second liquid feeding device 7, a heat exchanger 8, a second-order screw unit 9, a pigment feeding device 10, a cooler 12 and a buffer tank device 13. The material storage device 1, the material sending device 3, the lateral material feeding device 4, the first-order screw unit 5, the heat exchanger 8, the second-order screw unit 9, the cooler 12 and the buffer tank device are sequentially connected from the upstream to the downstream. The first liquid feeding device 6 includes a metering hopper and a metering pump and performs accurate metering through the loss of weight. The liquid storage device 2 is connected, through the first liquid feeding device 6, to the lateral material feeding device 4 and the first-order screw unit 5 separately, the liquid storage device 2 conveys a part of liquid material to the lateral material feeding device 4, the part of liquid material is mixed by stirring with the material from the material storage device 1, the liquid storage device 2 directly conveys the other part of the liquid material to the first-order screw unit 5, and the other part of the liquid material is mixed by stirring with the mixed material from the lateral material feeding device 4. In addition, the second liquid feeding device 7 is provided and includes a metering hopper and a metering pump, and performs accurate metering through the loss of weight. The liquid storage device 2 is connected, through the second liquid feeding device 7, to the first-order screw unit 5. The second liquid feeding device 7 serves as an auxiliary of the first liquid feeding device 6 to perform more accurate liquid material metering so that the material sending mode in which the first liquid feeding device 6 performs rough metering and the second liquid feeding device 7 performs, as an auxiliary, fine metering is implemented.

Figure 2:
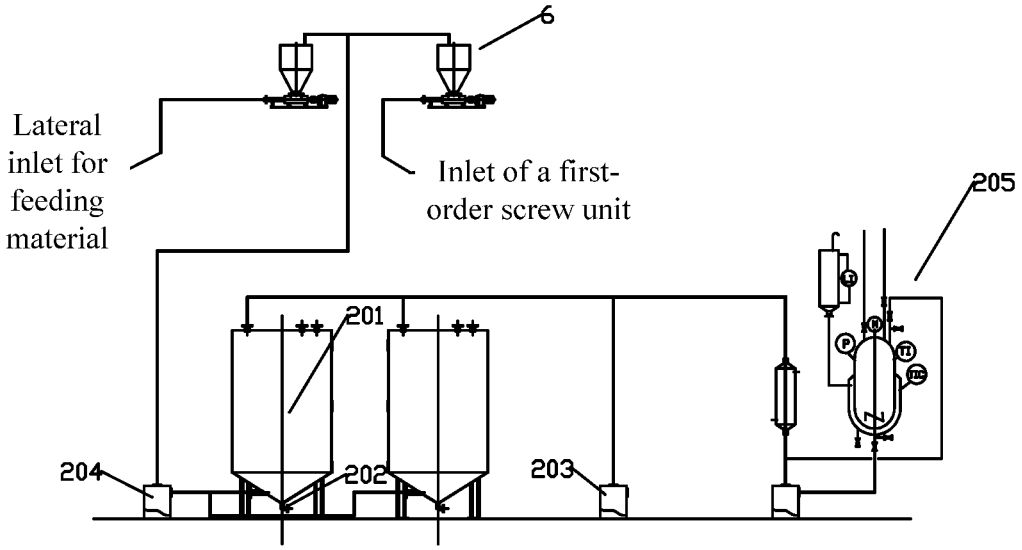
FIG. 2 illustrates a liquid storage device according to the present disclosure.

FIG. 2 is a detailed structural view of the liquid storage device according to the present disclosure. In FIG. 2, the liquid storage device 2 includes two liquid storage tanks 201. A pressure-type liquidometer is provided below the liquid storage tank 201. The pressure-type liquidometer 202 is configured to detect the liquid level of the liquid storage tank 201. Moreover, the liquid storage device 2 is also provided with a storing high-viscosity pump 203. The storing high-viscosity pump 203 receives external liquid material. In the embodiment, the storing high-viscosity pump 203 is connected to an online raw material liquid pre-preparation system 205. The online raw material liquid pre-preparation system 205 includes a reaction kettle, a high-viscosity pump, a thermal-oil heating device, a cooler and an electrical control system. A weighing module for measuring the weight of the various mixed material liquid is mounted to the reaction kettle. The cooler allows cooling water to pass through such that outlet material can be cooled, and the requirement that material on the normal temperature is supplied online can be met. When the liquid level gauge 202 detects that the liquid storage tank 201 requires replenishment of liquid material, the online raw material liquid pre-preparation system 205 supplies material to the storing high-viscosity pump 203, and the storing high-viscosity pump 203 starts and conveys liquid material to the liquid storage tank 201. Moreover, the liquid storage device 2 is further provided with an outfeed high-viscosity pump 204. The outfeed high-viscosity pump 204 is configured to pump the liquid materials in the liquid storage tank 201 to the first liquid feeding device 6, and the liquid material is conveyed by the first liquid feeding device 6 to the lateral material feeding device 4 and the first-order screw unit 5.

Figure 3:
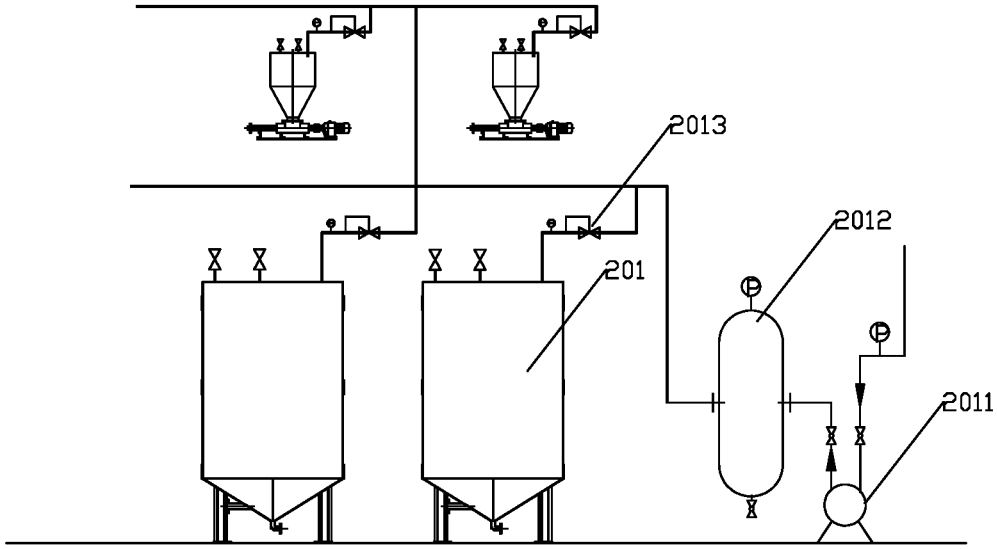
FIG. 3 illustrates a nitrogen sealing system according to the present disclosure.

Alternatively, various liquid material storage metering units are sealed by nitrogen. In the embodiment, using the liquid storage device as an example, as shown in FIG. 3, the nitrogen sealing system includes a nitrogen generator 2011, a gas storage tank 2012, a self-operated pressure reducing valve 2013, a nitrogen discharging valve and a safety valve. The self-operated pressure reducing valve 2013 adjusts pressure by taking the pressure of pressure measuring points of each working tank or metering hopper. The pressure measured is controlled in a range of kilopascals so that online metering of production is not influenced.

Figure 4:
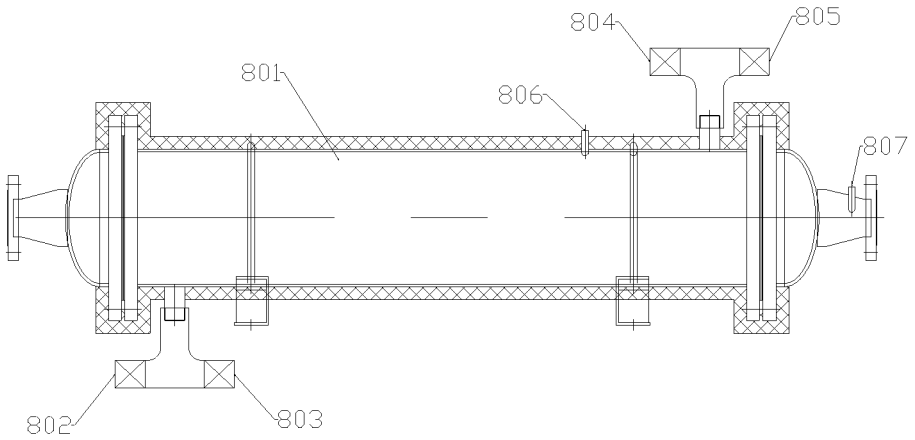
FIG. 4 illustrates a heat exchanger according to the present disclosure.

FIG. 4 is a structural view of a heat exchanger according to the present disclosure. The heat exchanger 8 includes a storage tank 801. A plurality of copper pipes are disposed within the storage tank 801. An inlet end of the storage tank 801 is connected to a material outlet of the first-order screw unit 5, and an outlet end of the storage tank 801 is connected to a material inlet of the second-order screw unit 9. The storage tank 801 is provided with a chilled water inlet valve 802, a hot water inlet valve 803, a chilled water outlet valve 804, a hot water outlet valve 805 and a material temperature probe 806. The chilled water inlet valve 802 and the hot water inlet valve 803 are controlled in an interlocking mode. That is when the chilled water inlet valve 802 is opened/closed, the hot water inlet valve 803 is closed/opened. The chilled water inlet valve 802 and the chilled water outlet valve 804 are controlled in a cascade mode, and the hot water inlet valve 803 and the hot water outlet valve 805 are also controlled in the cascade mode. Initially, the temperature of the material temperature probe 806 is relatively low, and the hot water generated by the first-order screw unit 5 is supplied to the heat exchanger 8. The hot water enters the plurality of copper pipes in the heat exchanger 8 from the hot water inlet valve 803 and heats the original residual material in the heat exchanger 8. When the material temperature probe 806 reaches a set temperature, the first-order screw unit 5 starts to supply material to the heat exchanger such that the material is prepared to be conveyed to the second-order screw unit 9. The melt pressure probe 807 is configured to detect the conveying situation of the materials, and once the original residual material in the heat exchanger 8 has been emptied, chilled water may be supplied to the heat exchanger 8 as required by the process. At this time, the hot water inlet valve 803 is closed, and due to the interlocking control, the chilled water inlet valve 802 and the chilled water outlet valve 804 are opened, and the chilled water enters, through the chilled water inlet valve 802, the plurality of copper pipes in the storage tank 801, so that the automatic cold-heat transfer is implemented. By the self-contained hot water heating function, energy is saved, and the original residual material in the storage tank can be melted and completely emptied, so that when the chilled water is input, the heat exchanger is in a state with the best cooling effect.

Figure 5:
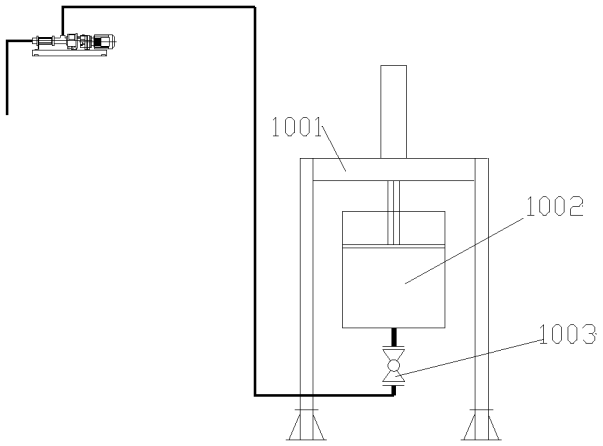
FIG. 5 illustrates a pigment feeding device according to the present disclosure.

FIG. 5 is a schematic view showing a pigment feeding device of the automatic sealant production line according to the present disclosure. The pigment feeding device 10 includes a pigment storage device and a metering pump. The pigment storage device includes a material pressing machine 1001, a pigment storage tank 1002 and a valve 1003. An ultrasonic probe (not shown in the figure) is mounted to the material pressing machine. The pigment is quantitatively conveyed, through the metering pump, to the second-order screw unit 9 and is stirred and mixed evenly by the second-order screw unit 9, so that high pressure provided for static mixing when adding pigment is avoided. Meanwhile, the ultrasonic probe disposed on the material pressing machine 1001 can measure the lowering position of a pressure plate and display the storage state of the pigment. When the pigment in the pigment storage tank 1002 is in a lower position, an alarm can be given in time so that rapid replacement can be achieved, and continuous production can be ensured.

Figure 6:
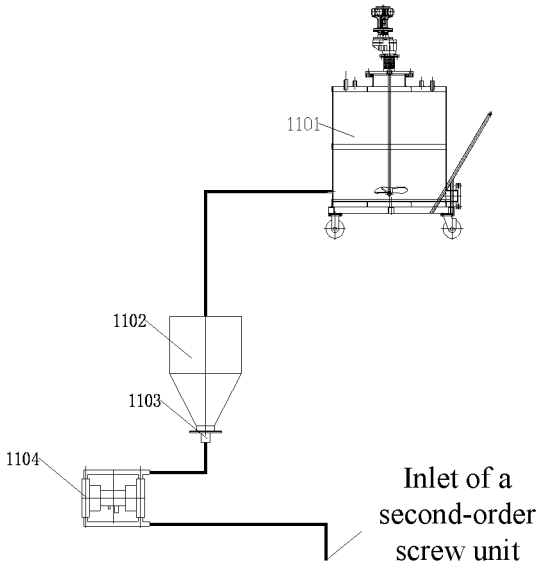
FIG. 6 illustrates a third liquid feeding device according to the present disclosure.

FIG. 6 is a schematic view showing a third liquid feeding device of the automatic sealant production line according to the present disclosure. The third liquid feeding device 11 conveys adjuvant. The adjuvant is an inflammable, explosive and volatile liquid and is prone to react with air. Therefore, the third liquid feeding device 11 includes a pneumatic stirring liquid storage tank 1101, a metering hopper 1102, a pneumatic valve 1103 and a pneumatic diaphragm pump 1104. The storage amount of the metering hopper 1102 is preset, and pneumatic diaphragm pump 1104 precisely supplies a constant capacity of adjuvant by metering the loss of weight, so that accurately adding adjuvant is implemented. The pneumatic stirring liquid storage tank 1101 can evenly stir the adjuvant needed during production so that products are not influenced by non-uniform ingredients of the adjuvant caused by precipitation of a part of substances. Moreover, since the metering hopper has a function of pre-storing a certain amount of adjuvant, continuous production can be maintained when the liquid storage tank is replaced.

Preferably, the buffer tank device 13 in the embodiment includes three sets of nitrogen-sealed buffer tank devices with nitrogen sealing attached to the periphery.

Embodiment Two

In another embodiment of the present disclosure, other structures are substantially the same as the preceding embodiment, and the difference is that a downstream portion of the buffer tank device 13 is further connected to a filling device 14, an automatic boxing device 15 and an automatic palletizing device 16. The sealant is output from the buffer tank device 13 to the filling device 14 for being quantitatively bottled to form bottled sealant. Then, the bottled sealant is packaged and arranged by the automatic boxing device 15 and is boxed in a paper box. Finally, the boxed bottled sealant is conveyed to the automatic palletizing device 16 to be automatically palletized and wait for transportation.

The automatic boxing device 15 includes a paper box folding device, a boxing manipulator, a certificate placing device, a box sealing device, or the like.

It is to be noted that the preceding embodiments are merely alternative embodiments and the technical principles used in the present disclosure. Based on the scope of the present disclosure, any modification or substitution easy for those skilled in the art to conceive falls within the scope of the present disclosure.

What is claimed is:

1. An automatic sealant production line, comprising a sealant preparation apparatus and a packaging apparatus, wherein the sealant preparation apparatus comprises a material storage device, a liquid storage device, a material sending device, a lateral material feeding device, a first-order screw unit, a first liquid feeding device, a heat exchanger, a second-order screw unit, a pigment feeding device, a cooler and a buffer tank device, and the packaging apparatus comprises a filling device and a packaging device;

wherein the material storage device, the material sending device, the lateral material feeding device, the first-order screw unit, the heat exchanger, the second-order screw unit, the cooler and the buffer tank device are sequentially connected, the liquid storage device is connected, through the first liquid feeding device, to the lateral material feeding device and the first-order screw unit separately, and the pigment feeding device is connected to the second-order screw unit; and wherein a downstream portion of the buffer tank device is connected to the filling device, the filling device is configured to bottle sealant, and the packaging device is configured to box and palletize the bottled sealant.

2. The automatic sealant production line according to claim 1, further comprising a second liquid feeding device, wherein the liquid storage device is connected, through the second liquid feeding device, to the first-order screw unit.

3. The automatic sealant production line according to claim 2, further comprising a third liquid feeding device, wherein the third liquid feeding device comprises a pneumatic stirring liquid storage tank, a metering hopper, a pneumatic valve and a pneumatic diaphragm pump, wherein the pneumatic diaphragm pump is configured to convey adjuvant to the second-order screw unit.

4. The automatic sealant production line according to claim 1, wherein the liquid storage device comprises a liquid storage tank, a pressure-type liquidometer, an outfeed high-viscosity pump and an online raw material liquid pre-preparation system, wherein the online raw material liquid pre-preparation system comprises a reaction kettle, a high-viscosity pump, a thermal-oil heating device, a cooler and an electrical control system, the online raw material liquid pre-preparation system is configured to convey liquid material to the liquid storage tank, and the outfeed high-viscosity pump is configured to pump the liquid material.

5. The automatic sealant production line according to claim 1, wherein the pigment feeding device comprises a pigment storage device and a metering pump, wherein the pigment storage device comprises a material pressing machine, a pigment storage tank and a valve, wherein an ultrasonic probe is mounted to the pigment pressing machine, and the metering pump is configured to convey pigment in the pigment storage tank to the second-order screw unit.

6. The automatic sealant production line according to claim 1, wherein the heat exchanger comprises a storage tank and a plurality of copper pipes disposed within the storage tank, the plurality of copper pipes are configured to receive external hot water and chilled water, an inlet end of the storage tank is connected to a material outlet of the first-order screw unit, an outlet end of the storage tank is connected to a material inlet of the second-order screw unit, and the storage tank is provided with a chilled water inlet valve, a hot water inlet valve, a chilled water outlet valve, a hot water outlet valve and a material temperature probe.

7. The automatic sealant production line according to claim 6, wherein the chilled water inlet valve and the hot water inlet valve are configured to be controlled in an interlocking mode, the chilled water inlet valve and the chilled water outlet valve are configured to be controlled in a cascade mode, and the hot water inlet valve and the hot water outlet valve are configured to be controlled in the cascade mode.

8. The automatic sealant production line according to claim 7, wherein an inlet end of the heat exchanger is provided with a melt pressure probe.

9. The automatic sealant production line according to claim 1, wherein the packaging device comprises an automatic boxing device and an automatic palletizing device.

10. The automatic sealant production line according to claim 1, further comprising a liquid material storage metering unit, wherein the liquid material storage metering unit is configured to be sealed by nitrogen supplied by a nitrogen sealing system, wherein the nitrogen sealing system comprises a nitrogen generator, a gas storage tank, a self-operated pressure reducing valve, a nitrogen discharging valve and a safety valve.

11. The automatic sealant production line according to claim 10, wherein the automatic sealant production line further comprises a second liquid feeding device, wherein the liquid storage device is connected, through the second liquid feeding device, to the first-order screw unit.

12. The automatic sealant production line according to claim 11, wherein the automatic sealant production line further comprises a third liquid feeding device, wherein the third liquid feeding device comprises a pneumatic stirring liquid storage tank, a metering hopper, a pneumatic valve and a pneumatic diaphragm pump, wherein the pneumatic diaphragm pump is configured to convey adjuvant to the second-order screw unit.

13. The automatic sealant production line according to claim 10, wherein the liquid storage device comprises a liquid storage tank, a pressure-type liquidometer, an outfeed high-viscosity pump and an online raw material liquid pre-preparation system, wherein the online raw material liquid pre-preparation system comprises a reaction kettle, a high-viscosity pump, a thermal-oil heating device, a cooler and an electrical control system, the online raw material liquid to the liquid storage tank, and the outfeed high-viscosity pump is configured to pump the liquid material.

14. The automatic sealant production line according to claim 10, wherein the pigment feeding device comprises a pigment storage device and a metering pump, wherein the pigment storage device comprises a material pressing machine, a pigment storage tank and a valve, wherein an ultrasonic probe is mounted to the pigment pressing machine, and the metering pump is configured to convey pigment in the pigment storage tank to the second-order screw unit.

15. The automatic sealant production line according to claim 10, wherein the heat exchanger comprises a storage tank and a plurality of cooper pipes disposed within the storage tank, the plurality of copper pipes are configured to receive external hot water and chilled water, an inlet end of the storage tank is connected to a material outlet of the first-order screw unit, an outlet end of the storage is connected to a material inlet of the second-order screw unit, and the storage tank is provided with a chilled water inlet valve, a hot water inlet valve, a chilled water outlet valve, a hot water outlet valve and a material temperature probe.

16. The automatic sealant production line according to claim 15, wherein the chilled water inlet valve and the hot water inlet valve are configured to be controlled in an interlocking mode, the chilled water inlet valve and the chilled water outlet valve are configured to be controlled in a cascade mode, and the hot water inlet valve and the hot water outlet valve are configured to be controlled in the cascade mode.

17. The automatic sealant production line according to claim 16, wherein an inlet end of the heat exchanger is provided with a melt pressure probe.

* * * * *